US009968820B2

(12) United States Patent
Stockhausen

(10) Patent No.: US 9,968,820 B2
(45) Date of Patent: May 15, 2018

(54) ROTATIONAL EXERCISE DEVICE

(71) Applicant: Stephen Matthew Stockhausen, Durango, CO (US)

(72) Inventor: Stephen Matthew Stockhausen, Durango, CO (US)

( * ) Notice: Subject to any disclaimer, the term of this patent is extended or adjusted under 35 U.S.C. 154(b) by 196 days.

(21) Appl. No.: 14/991,562

(22) Filed: Jan. 8, 2016

(65) Prior Publication Data

US 2017/0197105 A1 Jul. 13, 2017

(51) Int. Cl.

| | |
|---|---|
| ***A63B 22/14*** | (2006.01) |
| ***A63B 21/22*** | (2006.01) |
| ***A63B 21/02*** | (2006.01) |
| ***A63B 21/00*** | (2006.01) |
| ***A63B 23/04*** | (2006.01) |

(52) U.S. Cl.

CPC ..... *A63B 21/22* (2013.01); *A63B 21/0004* (2013.01); *A63B 21/02* (2013.01); *A63B 23/04* (2013.01)

(58) Field of Classification Search

CPC ..... A63B 22/14

See application file for complete search history.

(56) References Cited

U.S. PATENT DOCUMENTS

| | | | | |
|---|---|---|---|---|
| 3,512,774 A | | 5/1970 | Honer | |
| 4,132,405 A | * | 1/1979 | Asher | A63B 22/14 482/147 |
| 4,953,858 A | * | 9/1990 | Zelli | A63B 21/023 482/147 |
| 8,771,157 B2 | * | 7/2014 | Caponigro | A63B 21/025 473/452 |

* cited by examiner

*Primary Examiner* — Loan H Thanh
*Assistant Examiner* — Rae Fischer
(74) *Attorney, Agent, or Firm* — Fox Law Group, LLC

(57) ABSTRACT

A rotational exercise device is disclosed. The rotational exercise device includes an upper platform rotatably coupled to a base. The base is configured to rest on the floor. Elastic members located in the base interact with posts located in the upper platform to provide rotatable resistance between the upper platform and base. The elastic members may be exchanged to provide a desired resistance. The rotatable resistance permits the user to perform controlled exercise movements to assist in the physical therapy of rotational joints.

8 Claims, 3 Drawing Sheets

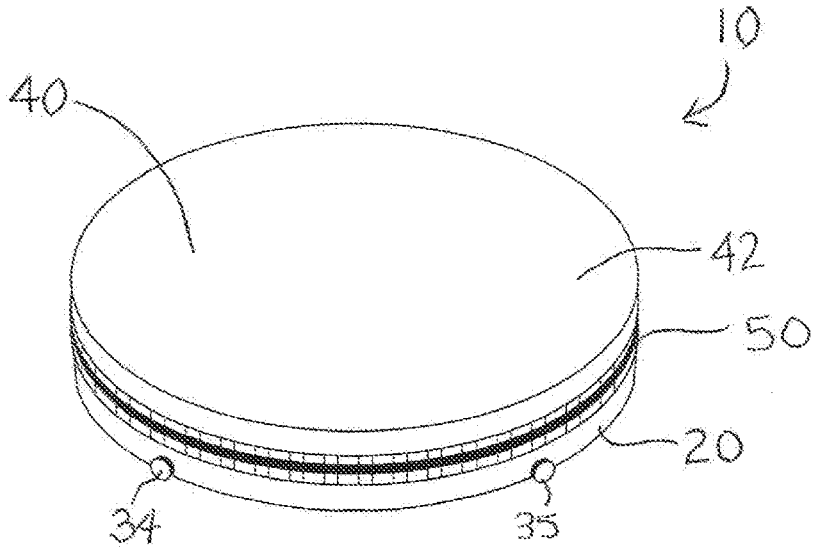
Figure 1
Figure 2
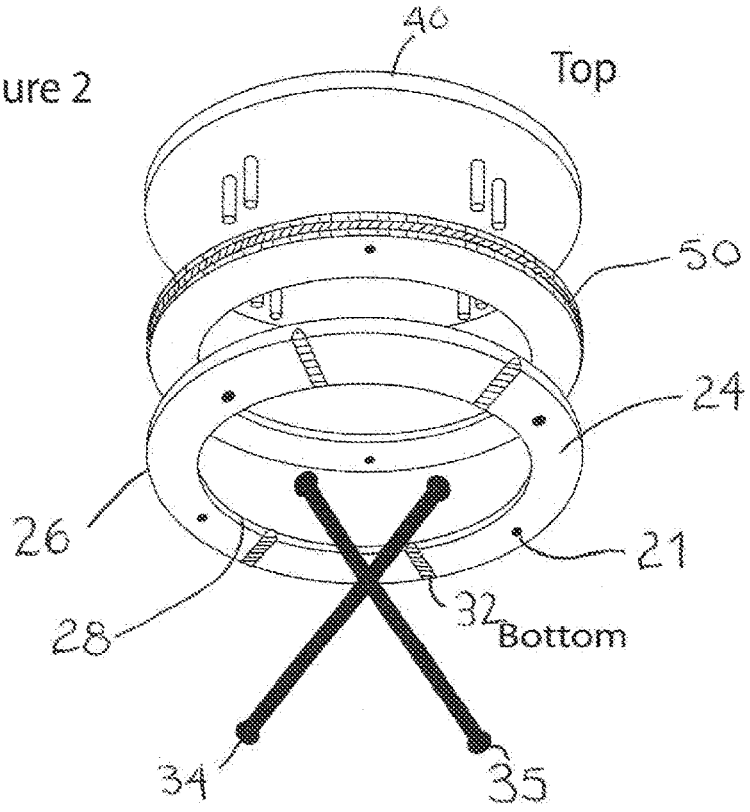

ROTATIONAL EXERCISE DEVICE

BACKGROUND

Field of the Invention

The present invention relates to the field of exercise equipment, and, in particular, to an adjustable rotational exercise device for increasing an individual's strength and agility.

Background Information

People want to return to an active healthy lifestyle as quickly as possible after injury. Physical therapy and rehabilitation following injury have become more important and more sophisticated. Injuries to rotational joints are common due to the number of sports and activities that stress hips, shoulders, wrists, and ankles. Devices with an upper surface coupled to a base using ball bearings allow rotational exercise in one plane and can aid in rehabilitation. An early example of such a device is U.S. Pat. No. 3,512,774 to Honer. A second example of a rotational exercise device is U.S. Pat. No. 8,771,157 to Caponigro. Caponigro discloses a rotational exercise device that includes a spring that resists rotation. The spring does not provide a wide range of variability or the ability to change resistance quickly and easily. Thus, what is needed is a rotational exercise device that controls movement in one plane and permits the user to easily alter the rotational resistance either during an exercise or from exercise to exercise.

SUMMARY OF THE INVENTION

The invention is a rotational exercise device with a circular base and a circular upper platform coupled together with a bearing surface to permit the upper platform to rotate relative to the base. The base includes elastic bands that cooperate with posts secured to the upper platform and oppose rotation of the upper platform relative to the base. The elastic bands may be easily exchanged with bands that permit increased or decreased resistance as desired by the user. The base and the upper platform are generally of the same diameter, although different diameters may be accommodated. The diameter of the base and of the upper platform may be sized to accommodate a user standing on the upper platform or maybe of smaller size that accommodates the user's foot or hand.

The base is configured to rest on a support surface such as the floor. The base includes several recesses to receive elastic bands. In one embodiment, the recesses are located on the compass points of the base. The elastic bands are placed into the recesses such that they form a cross. The elastic bands include a stop that rests against the outer diameter of the base and maintains the elastic band at a fixed length spanning the base while the unit is at rest. Attached to the upper platform are a series of posts. The posts may be secured to the upper platform by any such means as being press fit, threaded, or by any other manner that secures the posts to the upper platform. The posts secured to the upper platform engage the elastic bands of the base when the upper platform is rotatably coupled to the base. As the bands begin to stretch they oppose the rotation of the upper platform relative to the base providing a desired resistance to rotation.

A bearing surface rotationally couples the base to the upper platform. The surface is sufficient to support the required weight of the user. In some instances, the weight may be a portion of the user's bodyweight. In other instances the weight may be the user's full body weight. One of skill in the art would be able to select a bearing surface sufficient to support the required weight. Further it may be desirable to include a shield or seal to protect the bearing surface from the intrusion of dirt, dust, or other contaminants. The bearing surface may be a ball bearing, roller bearing, bushing or any other mechanical device that allows low friction between the base and the upper platform.

BRIEF DESCRIPTION OF THE DRAWINGS

Many aspects of the present invention can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

FIG. 1 is a perspective view of the present invention;

FIG. 2 is an exploded view of the invention shown in FIG. 1;

DETAILED DESCRIPTION OF INVENTION

Figure 3:
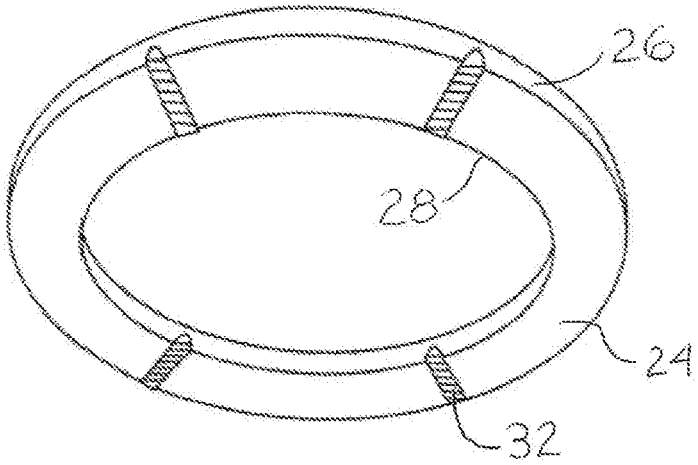
FIG. 3 is view of the base of the invention of FIG. 1.

The following detailed description is of exemplary embodiments of the invention. The description is not to be taken in a limiting sense but is made merely for the purpose of illustrating the general principles of the invention, since the scope of the invention is defined by the claims. Various inventive features are described below that can be used independently of one another or in combination with other features.

Broadly, with reference to FIG. 1, embodiments of the present invention generally provide a rotational exercise device 10 that restricts movement in one plane and provides rotational resistance. The rotational exercise device 10 is comprised of a substantially circular base 20 rotatably coupled to an upper platform 40 via a bearing surface 50. The base 20 contains recesses 32 that receive elastic bands 34, 35. The recesses 32 are located along the lower base surface 24 at the points of a compass. When in place, the elastic bands 34, 35 are substantially perpendicular to each other to form the shape of a cross. A substantially circular upper platform 40 is rotatably coupled to the base 20 by means of a bearing surface 50. The bearing surface permits the upper platform 40 to rotate with reduced friction relative to the base 20. The upper platform 40 has a series of posts 46 that interact with the elastic bands 34, 35 when the upper platform 40 is coupled to the base 20. When the upper platform 40 rotates relative to the base 20, the elastic bands 34, 35 oppose rotation of the posts 46 of creating a resistance to rotation of the upper platform 40. Thus, the user is able to exercise in one plane with controlled resistance created by the elastic bands 34, 35.

In one embodiment, the base 20 and the upper platform 40 are the same diameter. The diameter maybe such that a user can stand on the upper platform 40 with both feet. In such an embodiment, the rotational exercise device 10 is configured to support the user's entire bodyweight or the user's body weight plus additional weights. In another embodiment, the rotational exercise device 10 maybe configured to support a user's hand or foot. In such an embodiment, the diameter of the base 20 and the upper platform 40 maybe reduced, and the rotational exercise device 10 maybe design to support less than the user's whole body weight. In another embodiment, the base 20 maybe of greater diameter then the upper platform 40, and in another embodiment the upper platform 40 maybe of a greater diameter then the base 20. In yet another embodiment, the upper platform 40 may be configured to support a hand by means of a handle.

FIG. 3 shows the base 20 has an upper base surface 22 and a lower base surface 24. The upper base surface 22 is configured to be connected to the bearing surface 50. The lower base surface 24 is configured to rest on the ground or a support surface. The lower base surface may also include base pads 21 to support the rotational exercise device 10.

Lower base surface 24 has two or more recesses 32. In one embodiment, there are four recess 32 located at the points of a compass or at 0°, 90°, 180°, and 270° around the lower base surface 24. The recesses 32 are configured to receive the elastic bands 34, 35. In the above embodiment, when the elastic bands 34 are placed into the recesses 32, the elastic bands span the base 20 and form the shape of a cross. In another embodiment, four recesses 32 may be located in the lower base surface 24 such that the elastic bands 34, 35 are substantially parallel to each other. A further embodiment the may have just two recesses 32 in the lower base surface 24. In such an embodiment, the exercise device 10 utilizes only one elastic band 34. It will be understood by one of skill in the art that the base 20 can be configured in a number of different ways accommodate one or more elastic bands 34 to span the base 20. The elastic bands may be held in place by clips for example or other means of retaining the elastic band 34 to span the base 20.

In one embodiment of the invention, the elastic bands 34, 35 span base 20 in a pre-tensioned state. In another embodiment, the elastic bands 34, 35 are initially in a state of rest. The elastic bands 34 maybe made from any material that may be stretched and then substantially return to its original length. In one embodiment of the elastic band 34, the material maybe synthetic rubber; however, any elastic material may be used. The elastic band 34 may be hollow or it may be solid. In one embodiment, the elastic bands 34, 35 have a stop that interacts with the outer diameter of the base 26 such to resist stretching of the elastic band 34. As stated above, it is within the scope of this invention that one may use one, two or more elastic bands as desired. Elastic bands of various resistances maybe used to increase the opposition to rotation of the upper platform 40 relative to the base 20. Additionally instead of the elastic band 34 having a stop at each end, one may simply tie a knot in the elastic band such that the knot rests against the outer diameter of the base 26 to resist movement of the elastic band 34 when it is stretched. The elastic band 34 may also be different colors to provide a color code to the user for how much the elastic band will resist rotation.

Figure 4:
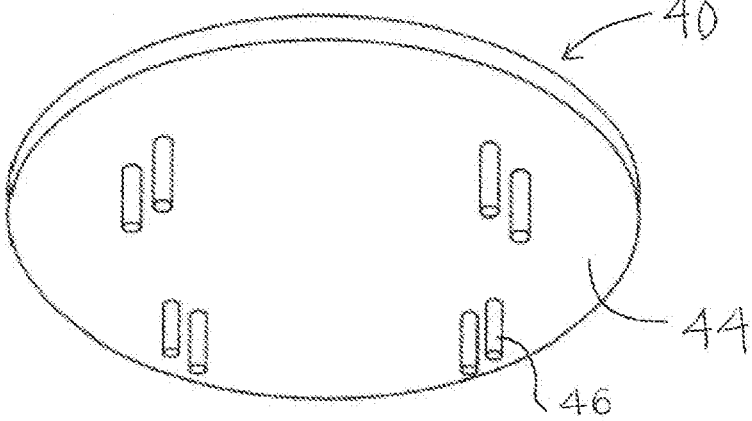
FIG. 4 is a view of the upper platform of the invention of FIG. 1.

With reference to FIG. 4, the upper platform 40 includes a support surface 42 and a lower platform surface 44. The support surface 42 may be configured to include a higher fiction surface to decrease the chance of the user slipping from the surface. The lower platform surface 44 is configured to be connected to the bearing surface 50. The upper platform 40 further includes a series of posts 46 fixed to the upper platform. The posts 46 maybe press fit, threaded, or fixed to the upper platform 40 by any well-known means. The posts 46 may be attached perpendicular to the lower platform surface 44 or attached in another plane relative to the lower platform surface 44. In one embodiment eight posts 40 are fixed to the upper platform 40. The posts 46 may be constructed of metal or any the material of sufficient strength to remain fixed into the upper platform 40 and not break when interacting with the elastic bands 34, 35. In one embodiment, the posts 46 are configured such that when the base 20 is coupled to the upper platform 40 the posts bestride the elastic bands 34, 35. Thus as the upper platform 40 is rotated relative to the base 20, the elastic bands 34, 35 oppose rotation of the posts 46 creating resistance to rotation between the upper platform 40 in the base 20. It will be known to one of skill in the art, that the number of posts 46 may depend upon the number of elastic bands 34, 35 and the orientation of the elastic bands 34, 35. In a simple embodiment, one elastic band 34 spans the base 20 and one post 46 is fixed to the upper platform 40. As the upper platform 40 rotates relative to the base 20 the elastic band 34 will oppose rotation of the post 46 creating resistance to rotation.

A bearing surface 50 is interposed between the base 20 in the upper platform 40. The bearing surface 50 rotatably couples the base 20 and the platform 40 allowing low friction rotation between the two members. The base 20 and the platform 40 may by fixedly coupled or removably coupled. The bearing surface 50 may be comprised of a number of different mechanical devices such as a lazy susan bearing, ball bearings, roller bearings, bushings, or any other mechanical device that permits low-friction rotation. In one embodiment the bearing surface 50 also permits the upper platform 40 to rotate in one plane. Another embodiment, the base 20 and or the upper platform 40 have surfaces to limit the movement of the upper platform 40 to one rotational plane. Example maybe a flange formed as part of the upper platform 40 that interacts with a surface of the base 20 such that the upper platform 40 does not substantially tip or tilt. In a further embodiment, the bearing surface may be form as part of the base 20 of formed as part of the upper platform 40.

In another embodiment, the rotational exercise device 10 maybe configured in the opposite manner where as the posts 46 are located in the base and the elastic members 34, 35 are located in the upper platform 40. The choice of locating the post and the elastic members 34, 35 are within the skill of one of in art. In this embodiment the post 46 will oppose rotation of the elastic band 34 thus creating the rotational resistance of the upper platform 40.

Figure 5:
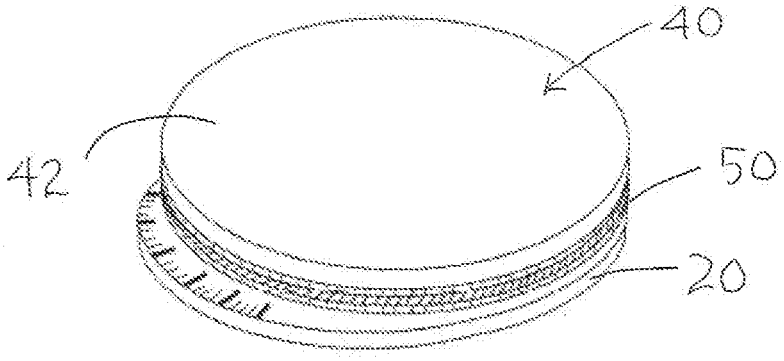
FIG. 5 is a view of an alternative embodiment of the invention of FIG. 1.
Figure 6:
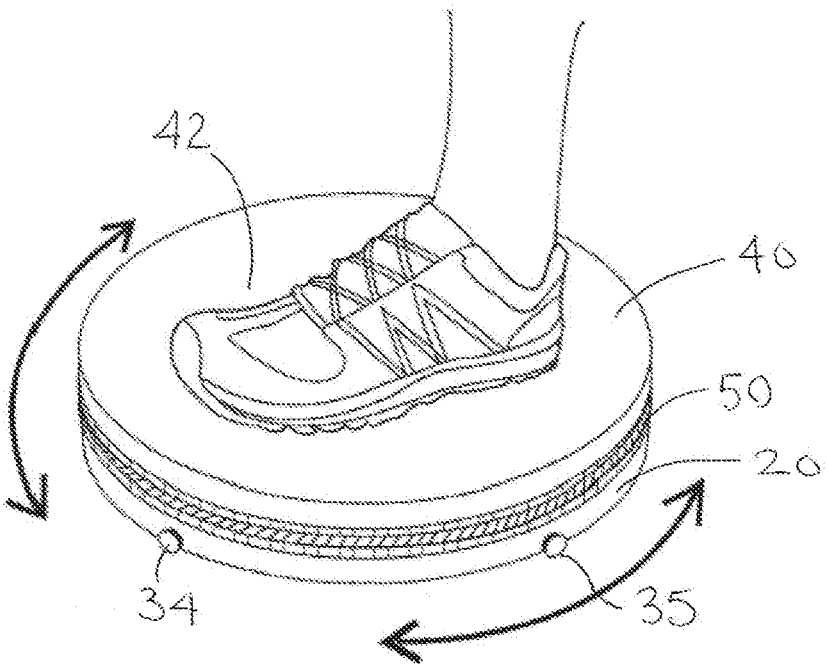
FIG. 6 is a view of a typical use of the invention of FIG. 1.

With reference to FIG. 5, although the base 20 in the upper platform 40 have been described above is being circular, these elements may be comprised of different shapes such as an egg shape, oval shape, or other various shapes. In one embodiment, the base 20 is shaped to include an area that is graduated to demonstrate to the user the number of degrees of rotation in either direction the user as rotated the upper platform 40 relative to the lower base 20. This can assist in the user being able to evaluate the amount of rotational rehabilitation one has achieved.

The rotational exercise device 10 provides rotational resistance through a closed chain system for improved joint position and activation of the body's dynamic stabilizers. It can be used to rehabilitate complex total hip arthroplasty patients with a history of recurrence dislocation and subluxations. The exercise device 10 may also provide resistance to neutral positioning or squat lunge and push-up training. Thus, it may be used as both a rehabilitation device and a general strength-training device.

In the rehabilitation setting the device mentioned may be utilized to both generate and resist rotational movement. In a method of use, a user may stand on the device with one foot, or with each foot on a separate device, and rotate their legs against the resistance generated by the elastic bands providing a novel means of "closed kinetic chain" strengthening of the musculature known as the deep rotators of the hip. A similar technique may be applied to the upper extremities while in a "pushup" position or in quadruped kneeling. Relating to the second technique mentioned, a user might assume the same position as described in the first technique, but this time pre-load tension on the elastic bands. Then, while maintaining a stable foot/hand position throughout the technique, perform a dynamic exercise such as a squat or pushup. This challenges the users ability to activate the appropriate musculature needed to maintain the desired position of the joints affected by the rotational forces placed upon them via the device. In specific reference to the squat, resisting internal rotation of the hip during the exercises provides targeted strengthening required to treat a very common biomechanical fault found in a wide range of orthopedic injuries.

The exercise device 10 provides further benefit such that the resistance is created through the use of common elastic bands or therabands. These bands can be color-coded to provide a known resistance to the user or their length and thus their resistance maybe adjusted by shortening the length of the band as it expands the base 20 by using a clamp or by simply knotting the band too short.

It is understood that the foregoing relates to exemplary embodiments of the invention and that modifications may be made without departing from the spirit and scope of the invention as set forth in the following claims.

What is claimed is:

1. A rotational exercise device comprising:

a base configured to be supported by the floor, the base having an elastic band spanning the base;

an upper support platform rotatably coupled to the base by a bearing surface;

a post attached to the upper support platform; and wherein when the upper support platform rotates relative to the base, the post intersects the elastic band to elastically resist rotation of the upper support platform.

2. The rotational exercise device of claim 1, wherein the bearing surface is a bushing.

3. The rotational exercise device of claim 1, wherein the bearing surface is comprised of ball bearings.

4. A rotational exercise device comprising:

a base configured to be supported on the ground, the base having an elastic band spanning the base;

an upper support platform having two posts; and wherein the upper support platform is rotatably coupled to the base such that each post is located on either side of the elastic band and at least one of the posts intersects the elastic band to resist rotation of the upper support platform relative to the base.

5. The rotational exercise device of claim 4, wherein the elastic band may be removably replaced with an elastic band that creates a greater resistance to rotation of the upper support platform relative to the base.

6. The rotational exercise device of claim 4, wherein the base further comprises a second elastic band spanning the base substantially perpendicular to the first elastic member.

7. The rotational exercise device of claim 6, wherein the upper support platform comprises two additional posts, wherein the first and second posts are positioned astride the first elastic member and the third and fourth posts are located astride the second elastic member when the upper support platform is rotatably coupled to the base, and wherein each post is configured to intersect one of the elastic members to resist rotation of the upper support platform relative to the base.

8. A rotational exercise device comprising:

a first support platform, the first support platform having an elastic band spanning the first support platform;

a second support platform rotatably coupled to the first support platform by a bearing surface;

a post attached to the second support platform; and wherein when the second support platform rotates relative to the first support platform, the post intersects the elastic band to elastically resist rotation of the second support platform.

* * * * *